US008967290B2

(12) United States Patent
Bram

(10) Patent No.: US 8,967,290 B2
(45) Date of Patent: Mar. 3, 2015

(54) FUEL-POWERED ROCK BREAKER

(75) Inventor: Johan Bram, Kalmar (SE)

(73) Assignee: Construction Tools PC AB, Kalmar (SE)

( * ) Notice: Subject to any disclaimer, the term of this patent is extended or adjusted under 35 U.S.C. 154(b) by 670 days.

(21) Appl. No.: 12/452,164

(22) PCT Filed: Jun. 17, 2008

(86) PCT No.: PCT/SE2008/000399
§ 371 (c)(1),
(2), (4) Date: Dec. 16, 2009

(87) PCT Pub. No.: WO2009/005436
PCT Pub. Date: Jan. 8, 2009

(65) Prior Publication Data

US 2010/0101816 A1 Apr. 29, 2010

(30) Foreign Application Priority Data

Jul. 3, 2007 (SE) ..... 0701603

(51) Int. Cl.
*B25D 9/10* (2006.01)

(52) U.S. Cl.
CPC ..... *B25D 9/10* (2013.01)
USPC ..... 173/209; 173/90

(58) Field of Classification Search
CPC ..... B25D 9/10; F02B 2075/025
USPC ..... 173/209, 206, 90
See application file for complete search history.

(56) References Cited

U.S. PATENT DOCUMENTS

| | | | | | |
|---|---|---|---|---|---|
| 2,273,095 | A | * | 2/1942 | Fitch | 173/118 |
| 2,433,007 | A | * | 12/1947 | Weyandt | 173/209 |
| 2,479,593 | A | * | 8/1949 | Weyandt | 123/46 SC |
| 2,522,550 | A | * | 9/1950 | Weyandt | 123/46 SC |
| 2,551,987 | A | * | 5/1951 | Weyandt | 173/209 |
| 2,551,988 | A | * | 5/1951 | Weyandt | 123/46 R |
| 2,685,867 | A | * | 8/1954 | Bergman | 123/73 V |

(Continued)

FOREIGN PATENT DOCUMENTS

| | | | |
|---|---|---|---|
| GB | 572448 | A | 10/1945 |
| GB | 632495 | A | 11/1949 |

(Continued)

*Primary Examiner* — Andrew M Tecco
(74) *Attorney, Agent, or Firm* — Mark P. Stone

(57) ABSTRACT

The invention relates to a fuel-powered breaker machine (1) which has a cylinder (2, 2.3, 2.4) with two pistons (3, 4) disposed therein. The first of the pistons (3) is adapted to opening and closing at least an inlet aperture (5, 6) on an inlet side (I) in a cylinder shell wall (7), and an outlet aperture (8) on an opposite outlet side (O) in the cylinder shell wall (7), and, when the apertures (5, 6, 8) are closed, to compressing against the second piston (4), which acts as the working piston of the breaker machine (1), an ignitable air/fuel mixture which is admitted via the inlet aperture/apertures (5, 6). The first piston (3) has a crown (11) which is shaped correspondingly to a crown (10) of the second piston (4) and which on said inlet side (I) has a recess (12) which serves, when the first piston (3) is at an upper dead center position, as a combustion chamber into which a spark plug (16) protrudes via the cylinder shell wall (7) on the inlet side (I), and, when the first piston (3) is at a lower dead center position, as an inlet chamber into which the inlet aperture/apertures (5, 6) leads/lead.

9 Claims, 1 Drawing Sheet

(56) References Cited

U.S. PATENT DOCUMENTS

| | | | | | |
|---|---|---|---|---|---|
| 2,686,501 | A | * | 8/1954 | McKelvy | 123/46 R |
| 2,740,385 | A | * | 4/1956 | Haage | 123/179.16 |
| 2,764,138 | A | * | 9/1956 | Wahlsten et al. | 173/110 |
| 2,857,888 | A | * | 10/1958 | Guthrie | 173/61 |
| 3,154,154 | A | | 10/1964 | Wicklund | |
| 4,160,430 | A | * | 7/1979 | Bell | 123/432 |
| 4,497,376 | A | * | 2/1985 | Kurylko | 173/1 |
| 2009/0071672 | A1 | * | 3/2009 | Heichel et al. | 173/209 |

FOREIGN PATENT DOCUMENTS

| | | | | | |
|---|---|---|---|---|---|
| WO | WO 98/34016 | A1 | | 8/1998 | |
| WO | WO 01/94764 | A1 | | 12/2001 | |
| WO | WO 2006072297 | A1 | * | 7/2006 | E02D 7/12 |

* cited by examiner

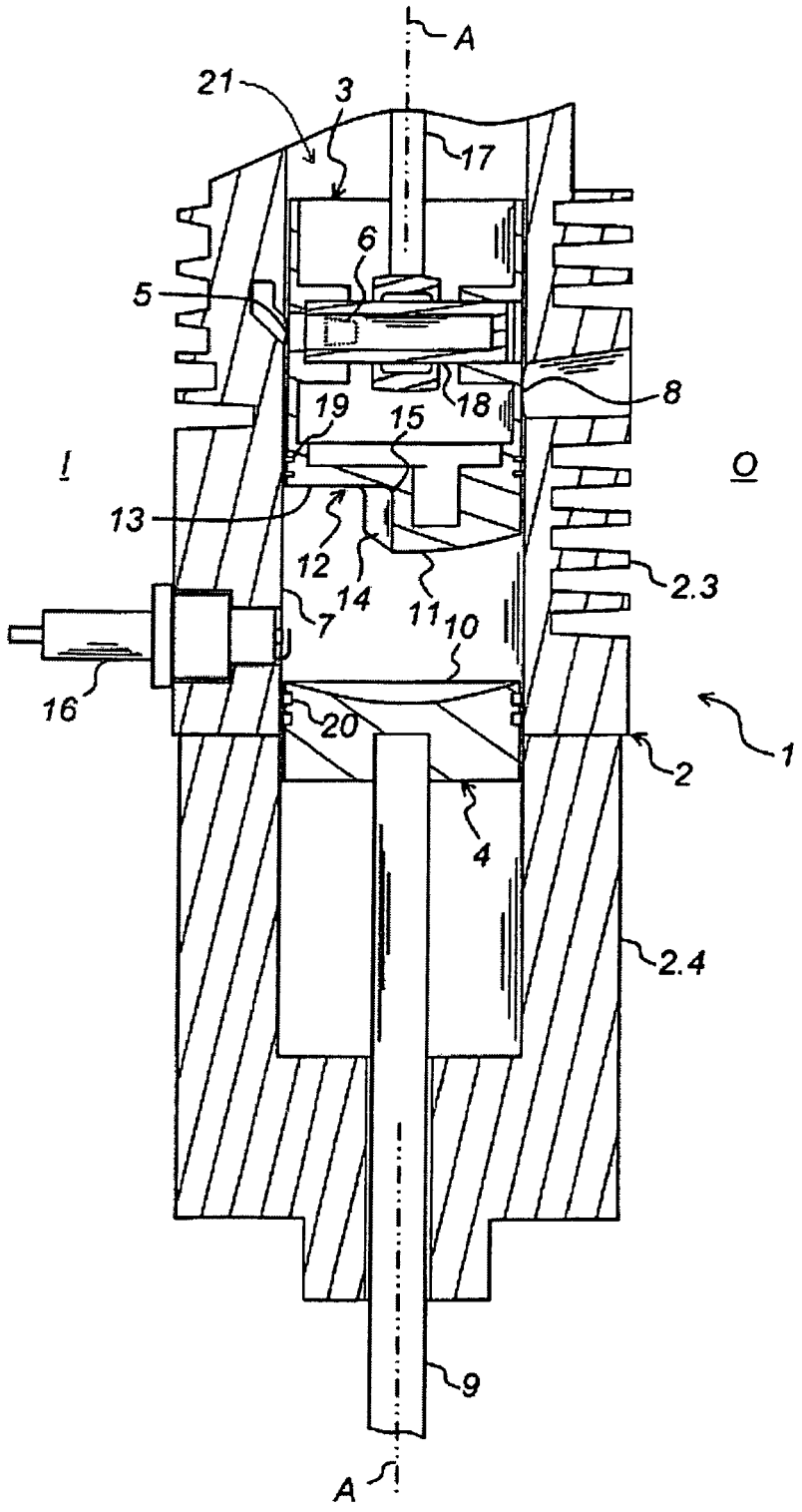
A
21
3
17
6
5
8
19
15
18
I
O
13
12
14
11
2.3
7
10
16
20
1
2
4
2.4
9
A

FUEL-POWERED ROCK BREAKER

FIELD OF THE INVENTION

The present invention relates to a fuel-powered breaker machine which has a cylinder with two pistons disposed therein, which pistons are movable within the cylinder along a common geometric axis, the first of the pistons acting as the piston in a crossflow two-stroke engine and adapted to opening and closing at least an inlet aperture on an inlet side in a cylinder shell wall and an outlet aperture on an opposite outlet side in the cylinder shell wall and, when the apertures are closed, to compressing an ignitable air/fuel mixture, which is admitted via the inlet aperture/apertures, against the second piston, which acts as the breaker machine's working piston and which during operation of the two-stroke engine imparts a reciprocating motion to a pushrod connected to the second piston.

STATE OF THE ART

A breaker machine according to the introduction is known from GB 572 448. In the known breaker machine, the first piston has a so-called nose adapted to preventing a air/fuel mixture from flowing directly from an inlet aperture to an outlet aperture, and the cylinder shell wall has a protrusion which corresponds to this nose and which, when the first piston reaches its upper dead centre position, causes movement of a then remaining portion of a combustion chamber towards the outlet side. A spark plug extends from the outlet side into this remaining portion of the combustion chamber and is adapted to igniting the air/fuel mixture and thereby causing the first and second pistons to move away from one another.

OBJECT OF THE INVENTION

It is known that two-stroke engines of the type used in the breaker machine according to GB 572 448 are sometimes affected by thermal problems due to excessive temperature differences between the engine's inlet side, where the inflowing relatively cold air/fuel mixture causes a certain cooling, and the engine's outlet side, where the combustion phase proceeds longest and the outlet aperture for the hot exhaust gases is also situated. The thermal difficulties concerned affect particularly the first piston and lead to its cracking as a result of temperature-induced stresses. It is also known that, for optimised combustion, two-stroke engines need good flow conditions within the engine's combustion chamber, which entail a certain mutual adaptation of the piston crown and the cylinder head. No such adaptation is detectable in the two-stroke engine in the breaker machine according to GB 572 448, in which the crown of the first piston has said nose but the crown of the second piston is entirely planar.

Against this background, the object of the invention is to improve the known solution according to GB 572 448 and to propose a fuel-powered breaker machine which operates under thermally more favourable conditions and with optimised combustion.

SUMMARY OF THE INVENTION

According to the invention, this object is achieved in a fuel-powered breaker machine according to the introduction by the first piston having a crown which is shaped correspondingly to a crown of the second piston and which has on said inlet side a recess which at an upper dead centre position of the first piston serves as a combustion chamber into which a spark plug protrudes via the cylinder shell wall on the inlet side, and at a lower dead centre position of the first piston serves as an inlet chamber into which the inlet aperture/apertures leads/lead.

Adopting for the crown of the first piston a shape which is complementary to the crown of the second piston results, during the compression phase, in substantially all of the air/fuel mixture being forced into the recess in the crown of the first piston, which thus serves as a combustion chamber from which a broad flame front effectively spreads after the ignition of the air/fuel mixture by the spark plug and during the working movement of the first and second pistons. When the first piston thereafter approaches its lower dead centre position, a large proportion of the exhaust gases is initially pushed out through the outlet aperture, followed immediately thereafter by opening of the engine's inlet aperture/apertures to admit a new air/fuel mixture. At this stage, the recess in the crown of the first piston serves conversely as an inlet chamber which prevents the air/fuel mixture from flowing transversely across the first piston to the still open outlet aperture. The invention thus results in the desired favourable flow conditions within the engine, thereby contributing to high power output, good fuel economy, smaller discharges of unburnt fuel and more uniform temperature conditions.

According to a preferred embodiment of the invention, the recess comprises a planar bottom portion and a wall portion which runs from the bottom portion to the piston crown, which wall portion is preferably connected to the bottom portion via a rounded transition, is parallel with said geometric axis and opens out in an arcuate manner towards the inlet side.

The advantage of this solution is that it provides the aforesaid combustion chamber with an optimum shape with regard to concentrating the air/fuel mixture round the spark plug and provides the aforesaid inlet chamber with an optimum shape as regards preventing fuel leakage to the outlet aperture.

A central inlet aperture for a rich air/fuel mixture is preferably disposed on said inlet side, with secondary inlet apertures on their respective sides of the central inlet aperture for a lean air/fuel mixture or fresh air.

The advantage of this is that the secondary inlet apertures make possible so-called stratified charging, which may further reduce the fuel leakage to the outlet aperture by creating a kind of air curtain between said outlet aperture and the central inlet aperture for rich air/fuel mixture, the recess in the piston crown being a prerequisite for ignition to be possible at all.

If secondary inlet apertures are provided, they preferably lead in where the wall portion meets the cylinder shell wall.

This contributes to the formation of a more stable air curtain which therefore more effectively screens the central inlet aperture from the outlet aperture.

The crown of the first piston is preferably convex and the crown of the second piston correspondingly concave.

It has been found that this embodiment with a convex crown on the first piston and a corresponding concave crown on the second piston is that which results in the most optimised combustion with regard to fuel consumption and exhaust discharges. This is because the curvature of the convex shape further lengthens the path for an inflowing air/fuel mixture from the central inlet aperture to the open outlet aperture, leading to reduced fuel leakage.

BRIEF DESCRIPTION OF THE DRAWING

A preferred embodiment of the invention is described in more detail below with reference to the attached drawing, in which:

FIG. 1 depicts a fuel-powered breaker machine according to the invention in a longitudinal sectional view.

DESCRIPTION OF THE PREFERRED EMBODIMENT

The fuel-powered breaker machine 1 depicted in FIG. 1 has a cylinder denoted generally by ref. 2 and comprising two cylinder halves 2.3, 2.4 disposed in line with one another. A first piston 3 is disposed in the first cylinder half 2.3 and a second piston 4 in the second cylinder half 2.4. The two pistons 3, 4 are movable along a common geometric axis A and are sealed with respect to their respective cylinder halves 2.3, 2.4 by piston rings 19, 20.

The first piston 3 acts as the piston in a crossflow two-stroke engine which has on an inlet side I in a cylinder shell wall 7 three inlet apertures 5, 6, the first of which is a central aperture 5. The central aperture has direct contact with an air/fuel atmosphere in a crankcase 21, which begins where a piston rod 17 connected articulatedly to the first piston 3 by a spigot 18 leaves the cylinder half 2.3.

The two second inlet apertures 6 (only one of which, as a concealed item, is represented by broken lines in the diagram) are thus in contact with the crankcase but the contact here is instead of an indirect kind, e.g. via a cyclone separator (not depicted) which only allows air or extremely lean air/fuel mixture through from the crankcase atmosphere to the second apertures 6. The purpose of this is of course to prevent so-called scavenging losses, i.e. flow of unburnt air/fuel mixture from the central inlet aperture 5 to an exhaust port or outlet aperture 8 situated on an outlet side O in the cylinder shell wall 7 directly opposite the central inlet aperture 5.

During operation of the two-stroke engine of the breaker machine 1, the first piston 3 is adapted in a conventional manner to opening and closing the inlet apertures 5, 6 and the outlet aperture 8 and, when the apertures 5, 6, 8 are closed in a first stroke, to compressing against the second piston 4 the ignitable air/fuel mixture admitted via the inlet apertures 5, 6. The ignition is effected by a spark plug 16 which extends into the cylinder 2 via the cylinder shell wall 7. After ignition of the air/fuel mixture, the first piston 3 of the breaker machine 1, in a second stroke, is pushed rapidly and with great force back towards its initial position with open apertures 5, 6, 8, while at the same time the second piston 4 of the breaker machine 1 is pushed rapidly and with great force away from the first piston 3, causing a push rod 9 to which the second piston 4 is connected to perform a working stroke for powering, for example, a chisel steel (not depicted). When the two pistons 3, 4 thereafter reach their extreme outer or dead centre positions, they change direction and begin the first stroke again.

To further reduce the aforesaid scavenging losses of the breaker machine 1 with the two-stroke engine, the first piston 3 of the depicted preferred embodiment of the invention has a substantially bulging or convex crown 11 and the second piston a corresponding cup-shaped or concave crown 10. In addition, the crown 11 of the first piston 3 has a recess 12 which on the inlet side I extends somewhat down the piston 3 and has a planar bottom 13 just above the piston rings 13. Between the planar bottom 13 and the convex piston crown 11, a wall 14 runs vertically towards the bottom 13. The wall 14 curves in an arcuate manner towards the inlet side I and is connected downwards to the bottom 13 via a rounded transition 15.

The recess 12 described above serves, when the first piston 3 is at a lower dead centre position, as an inlet chamber into which the inlet aperture/apertures 5, 6 leads/lead, and, when the first piston 3 is at an upper dead centre position, as a combustion chamber into which the spark plug 16 protrudes.

In the function of the recess 12 as an inlet chamber, its vertical wall 14 effectively prevents rich air/fuel mixture from flowing directly from the inlet aperture to the outlet aperture 8. In addition, the vertical wall 14 of the recess 12, which opens out in an arcuate manner towards the inlet side I, constitutes, in cooperation with the inlet apertures 6 for lean air/fuel mixture or preferably for clean air as a result of these apertures 6 being situated on their respective sides of the central inlet aperture where the wall 14 meets the cylinder shell wall 7, a kind of air curtain between the central inlet aperture 5 and the outlet aperture 8, which air curtain also counteracts scavenging losses.

In its function as a combustion chamber, the recess 12 makes it possible for the two-stroke engine of the breaker machine 1 to operate with so-called stratified charging, based in principle on ignition of a lean air/fuel mixture by a rich air/fuel mixture which is itself ignited by, for example, a spark plug, such as the spark plug 16 in the case here described. More specifically, the stratified charging is made possible by the bottom 13 and the vertical wall 14 of the recess 12, which, during the compression stroke of the first piston 3, carry with them the aforesaid air curtain, which in its turn, during that compression stroke, shuts the rich and therefore ignitable air/fuel mixture from the central inlet aperture 5 in towards the cylinder shell wall 7 until it reaches the spark plug 16.

According to the invention, the first and second pistons 3, 4 have crowns 11, 10 of mutually corresponding shapes. The purpose of this is that when the pistons 3, 4 are closest to one another there should be only a minimum residual space between them and that all the gases in the cylinder 2 should thereby be forced into the recess 12. This also contributes to a high power output, a fact which can be utilised, particularly in relation to handheld machines such as the breaker tool 1, for, inter alia, weight reduction. For maximum reduction of scavenging losses, the shapes of the piston crowns 11, 10 may, as depicted in the diagram, be convex and concave respectively, but one skilled in the art will appreciate that other shapes and even an entirely flat shape are within the bounds of the possible.

The invention claimed is:

1. A fuel-powered breaker machine which has a cylinder with a first piston and a second piston disposed therein which are movable within the cylinder along a common geometric axis, the first piston acting as the piston in a crossflow two-stroke engine and is adapted to opening and closing at least an inlet aperture on an inlet side in a cylinder shell wall, and an outlet aperture on an opposite outlet side in the cylinder shell wall, and, when the apertures are closed, to compressing an ignitable air/fuel mixture, which is admitted via the inlet aperture, against the second piston acting as the working piston of the breaker machine and which during operation of the two-stroke engine imparts a reciprocating movement to a push rod connected to the second piston, wherein the first piston has a crown which is shaped correspondingly to a crown of the second piston and which on said inlet side has a recess which serves, when the first piston is at an upper dead center position, as a combustion chamber into which a spark plug protrudes via the cylinder shell wall on the inlet side, and, when the first piston is at a lower dead center position, as an inlet chamber into which the inlet aperture leads, said recess comprises a planar bottom portion and a wall portion which extends transversely from the planar bottom portion towards the crown of the first piston, and said inlet aperture comprises a central inlet aperture arranged on the inlet side for an air/fuel mixture with at least one secondary inlet aperture disposed to a side of said central inlet aperture for a less concentrated air/fuel mixture or fresh air, at least one of said inlet apertures directly connecting a crankcase with the inlet chamber formed from said recess in the first piston when the first piston is in said lower dead center position, the portion of the spark plug protruding into the combustion chamber is located entirely within said recess when the first piston is in said upper dead center position.

2. A breaker machine according to claim 1, in which the wall portion is connected to the bottom portion via a rounded transition, is parallel with said geometric axis, and opens out in an arcuate manner towards the inlet side.

3. A breaker machine according to claim 2, in which the crown of the first piston is convex and the crown of the second piston is correspondingly concave.

4. A breaker machine according to claim 2, in which the secondary inlet apertures lead in where the wall portion meets the cylinder shell wall.

5. A breaker machine according to claim 1, in which the secondary inlet apertures lead in where the wall portion meets the cylinder shell wall.

6. A breaker machine according to claim 5, in which the crown of the first piston is convex and the crown of the second piston is correspondingly concave.

7. A breaker machine according to claim 1, in which the crown of the first piston is convex and the crown of the second piston is correspondingly concave.

8. A fuel-powered breaker machine which has a cylinder with a first piston and a second piston disposed therein which are movable within the cylinder along a common geometric axis, the first piston acting as the piston in a crossflow two-stroke engine and is adapted to opening and closing at least an inlet aperture on an inlet side in a cylinder shell wall, and an outlet aperture on an opposite outlet side in the cylinder shell wall, and, when the apertures are closed, to compressing an ignitable air/fuel mixture, which is admitted via the inlet aperture, against the second piston acting as the working piston of the breaker machine and which during operation of the two-stroke engine imparts a reciprocating movement to a push rod connected to the second piston, wherein the first piston has a crown which is shaped correspondingly to a crown of the second piston and which on said inlet side has a recess which serves, when the first piston is at an upper dead center position, as a combustion chamber into which a spark plug protrudes via the cylinder shell wall on the inlet side, and, when the first piston is at a lower dead center position, as an inlet chamber into which the inlet aperture leads, said recess comprises a planar bottom portion and a wall portion which runs from the bottom planar portion towards the crown of the first piston, and said inlet aperture comprises a central inlet aperture arranged on the inlet side for an air/fuel mixture with at least one secondary inlet aperture disposed to a side of said central inlet aperture for a less concentrated air/fuel mixture or fresh air, the portion of the spark plug protruding into the combustion chamber when the first piston is in said upper dead center position being located entirely within said recess when said first piston is in said upper dead center position.

9. A fuel-powered breaker machine which has a cylinder with a first piston and a second piston disposed therein which are movable within the cylinder along a common geometric axis, the first piston acting as the piston in a crossflow two-stroke engine and is adapted to opening and closing at least an inlet aperture on an inlet side in a cylinder shell wall, and an outlet aperture on an opposite outlet side in the cylinder shell wall, and, when the apertures are closed, to compressing an ignitable air/fuel mixture, which is admitted via the inlet aperture, against the second piston acting as the working piston of the breaker machine and which during operation of the two-stroke engine imparts a reciprocating movement to a push rod connected to the second piston, wherein the first piston has a crown which is shaped correspondingly to a crown of the second piston and which on said inlet side has a recess which serves, when the first piston is at an upper dead center position, as a combustion chamber into which a spark plug protrudes via the cylinder shell wall on the inlet side, and, when the first piston is at a lower dead center position, as an inlet chamber into which the inlet aperture leads, said recess comprises a bottom portion and a wall portion which extends from the bottom portion towards the crown of the first piston, and said inlet aperture comprises a central inlet aperture arranged on the inlet side for an air/fuel mixture with at least one secondary inlet aperture disposed to a side of said central inlet aperture for a less concentrated air/fuel mixture or fresh air, said wall portion of said recess and said at least one secondary inlet aperture arranged so that said wall portion and the flow of said air/fuel mixture or air through said at least one secondary inlet aperture reduces flow of said air/fuel mixture from said central inlet aperture to said outlet aperture when said recess in said first piston serves as said inlet chamber.

* * * * *